US005499604A

United States Patent [19]

Ito et al.

[11] Patent Number: 5,499,604

[45] Date of Patent: Mar. 19, 1996

[54] POSITIVE CRANK VENTILATION APPARATUS FOR AN ENGINE SYSTEM

[75] Inventors: Eiji Ito, Nagoya; Tetsushi Suzuki, Aichi; Kaoru Ito, Okazaki; Hiroyuki Kawakubo, Toyota, all of Japan

[73] Assignee: Toyota Jidosha Kabushiki Kaisha, Toyota, Japan

[21] Appl. No.: 357,681

[22] Filed: Dec. 16, 1994

[30] Foreign Application Priority Data

Dec. 17, 1993 [JP] Japan ..... 5-318608

[51] Int. Cl.[6] ..... F01M 13/00; F02M 25/00

[52] U.S. Cl. ..... 123/41.86; 123/573

[58] Field of Search ..... 123/571, 572, 123/573, 41.86

[56] References Cited

U.S. PATENT DOCUMENTS

| | | | |
|---|---|---|---|
| 4,790,287 | 12/1988 | Sakurai et al. | 123/41.86 |
| 4,920,930 | 5/1990 | Sakano et al. | 123/41.86 |
| 4,945,887 | 8/1990 | Sakurai et al. | 123/41.86 |
| 5,069,192 | 12/1991 | Matsumoto et al. | 123/41.86 |
| 5,203,311 | 4/1993 | Hitomi et al. | 123/571 |

FOREIGN PATENT DOCUMENTS 60-173612 U 11/1985 Japan .

OTHER PUBLICATIONS

Technical Report No. 87–708, published by Japan Institute of Invention and Innovation on Jan. 20, 1987.

Technical Report No. 90–2587, published by Japan Institute of Invention and Innovation on Feb. 20, 1990.

*Primary Examiner*—David A. Okonsky

*Attorney, Agent, or Firm*—Kenyon & Kenyon

[57] ABSTRACT

In a supercharged engine, a supercharger and a throttle body disposed midway in an intake passage are located away from an engine block. A blow-by gas passage constituting a PCV apparatus is connected between a portion of the intake passage located on the upstream side of a throttle valve and a crankcase. The blow-by gas passage returns the blow-by gas collected in the crankcase to the intake passage. A cooling water passage extending from the engine block is connected to a radiator. A water passage extending from the radiator is connected to the engine block via the throttle body, which water passage encloses the blow-by gas passage in an intermediate portion thereof.

24 Claims, 6 Drawing Sheets

POSITIVE CRANK VENTILATION APPARATUS FOR AN ENGINE SYSTEM

BACKGROUND OF THE INVENTION

1. Field of the Invention

The present invention relates generally to an apparatus for returning blow-by gas collected in a crankcase of an engine to an intake passage so as to reuse it for combustion. More particularly, the present invention relates to a positive crankcase ventilation (PCV) apparatus to forcibly ventilate the crankcase through a gas passage by utilizing a negative pressure in the intake passage.

2. Description of the Related Art

Typically, there are gas leaks between an engine crankcase and its associated combustion chambers through the clearances between cylinders and their piston rings during the compression and power strokes. The leaked gas is known as blow-by gas. Most of the contents of the gas is an intake air-fuel mixture leaking from the combustion chambers in the compression stroke, and the rest is the exhaust gas. Hence, the blow-by gas contains a lot of hydrocarbon. Since the blow-by gas contains a lot of water exhibiting a strong acidity of pH 2 to 3, it has a great effect on deterioration of engine oil and formation of rust inside the engine.

Various devices have been employed to prevent blow-by gas from being released to the atmosphere by returning it to an intake passage. One of the devices is a PCV apparatus to forcibly ventilate the inside of a crankcase through a PCV valve and a gas passage utilizing a vacuum connected to the intake passage. The PCV valve regulates the flow of blow-by gas according to the amount of blow-by gas generated.

Japanese Unexamined Utility Model Registration Publication No. 60-173612 discloses an example of a PCV apparatus. FIG. 7 shows the apparatus of this publication. In the apparatus, a gas passage 51 connects a crankcase 53 of an engine block 52 and a location in the vicinity of a carburetor 55 (including an unillustrated throttle valve). The gas passage 51 allows the blow-by gas to flow therethrough. One end of the gas passage 51 is connected to a location in the vicinity of the carburetor 55 in order to induce a flow of blow-by gas utilizing a negative pressure occurring near the throttle valve. When a PCV valve 56 provided in the gas passage 51 opens, blow-by gas in the crankcase 53 flows to an intake passage 54 through the gas passage 51. The blow-by gas burns in a combustion chamber 57. Water passages 58, 59 for cooling water used for cooling the block 52 contact the gas passage 51 in the vicinity of the PCV valve 56. Cooling water discharged from a water pump (not illustrated) flows through the water passages 58, 59. The cooling water (water heated at the engine block 52) heats the PCV valve 56 and the gas passage 51. This heating prevents both the gas passage 51 and the PCV valve 56 from freezing.

In a modified example of the apparatus described above, a water passage runs along and contacts a gas passage similar to the passage 51. The cooling water flowing through the water passage heats the gas passage in an area extending in the lengthwise direction, and hence the gas passage is more effectively heated.

In some of recent models of vehicles, accessory devices such as a supercharger are disposed away from an engine block. Some of such vehicles employ a separated accessory drive system (SDS) where a throttle valve is located away from an engine block. In such vehicles, the distance between a radiator and the throttle valve is less than the distance between the throttle valve and the engine block. In vehicles which employ the SDS and the PCV apparatus, the throttle valve is located some distance away from the engine block, and hence the gas passage of the PCV apparatus necessarily becomes longer. It has been proposed that the cooling water passage described above be brought in contact this gas passage.

Also, there is a proposal that applies the apparatus disclosed in Japanese Unexamined Utility Model Registration Publication No. 60-173612 to vehicles employing the SDS. This application, however, requires a water passage to contact a longer gas passage over a longer distance for effectively preventing the gas passage from freezing. Moreover, there must be provided two water passages between the engine block and the gas passage. That is, a water feed passage is needed to carry the cooling water discharged from a water pump to the vicinity of the throttle valve. Further, a water return passage is needed which is disposed to run in contact with the gas passage along an area between a location near the throttle valve and a location near the block. Accordingly, the water passage becomes quite long, and the flow rate of the cooling water drops due to the increased flow resistance of the water passage. As a result, the heating of the gas passage may be insufficient, and the gas passage may freeze.

SUMMARY OF THE INVENTION

Accordingly, it is a primary objective of the present invention to provide a PCV apparatus for an engine employing an SDS wherein a cooling water passage is brought in contact with a blow-by gas passage and wherein cooling water is caused to flow, with reduced heat loss and flow resistance, through the water passage in order to effectively warm the blow-by gas passage against freezing.

To achieve the foregoing and other objects and in accordance with the purpose of the present invention, a PVC apparatus is provided. The system includes an engine having a block, and a crankcase wherein the crankcase contains blow-by gas. An engine cooling structure includes a radiator spaced apart from said engine, an outflow coolant passage connecting the engine to the radiator and a coolant return passage connecting the radiator to the engine, the outflow coolant passage and the radiator forming a hot coolant path, a pump for forcing coolant through said outflow coolant passage towards said radiator and an air intake passage having a throttle valve disposed therein. The throttle valve is spaced apart from said engine block and located closer to said radiator than to said engine block. The apparatus further has a gas passage for directing the blow-by gas to the air intake passage, a valve for controlling the flow of blow-by gas in the gas passage and a heating passage for heating the gas passage and connecting the hot coolant path to the engine. The heating passage includes a first portion extending from the hot coolant path to the gas passage and a second portion extending along a substantial portion of the gas passage. The first portion is shorter in length than the distance between the throttle valve and said engine.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

A positive crankcase ventilation (PCV) apparatus for an engine according to the present invention embodied in a vehicle will now be described in detail with reference to FIGS. 1 to 6.

Figure 1:
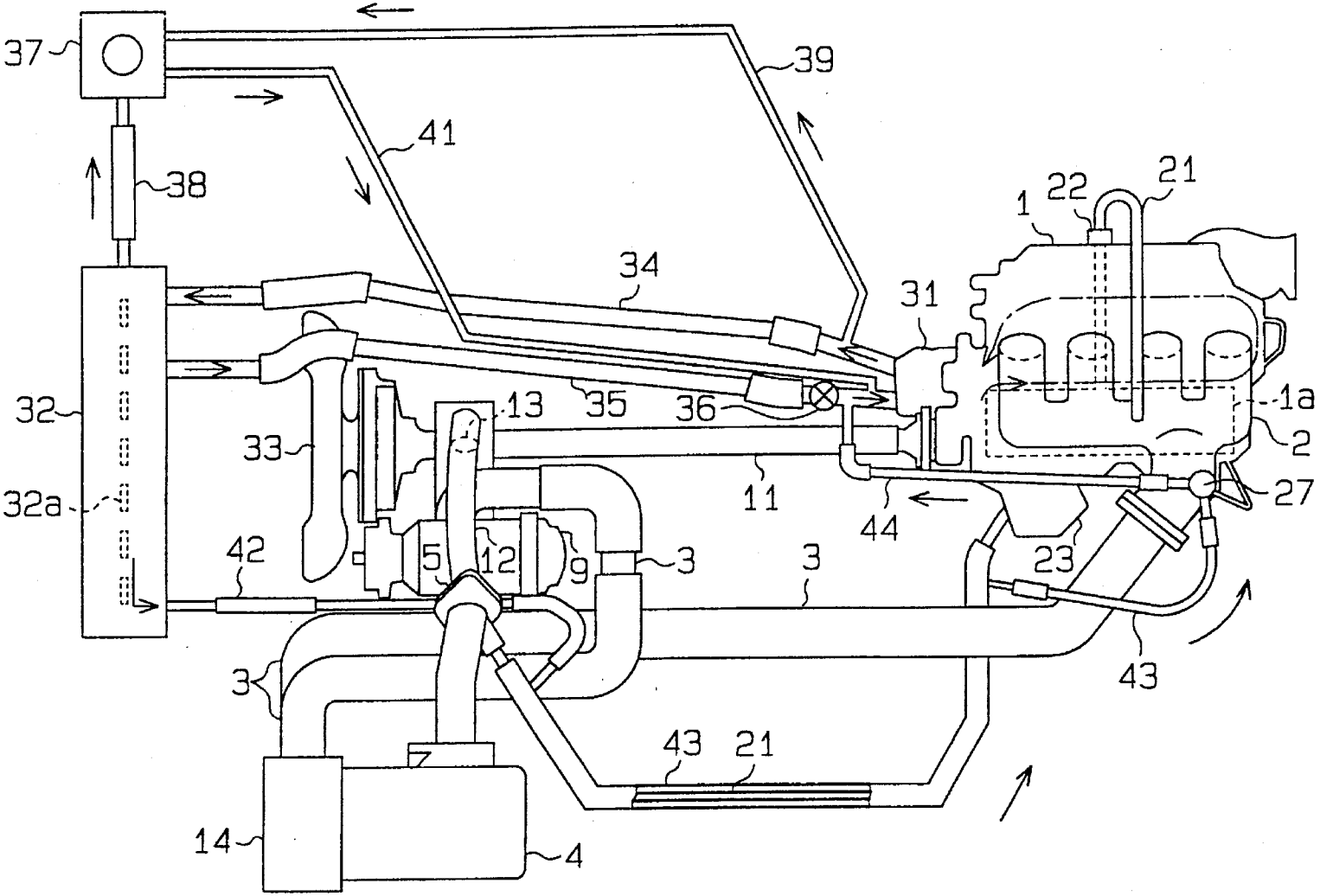
FIG. 1 is a schematic view showing the structure of a PCV apparatus and cooling structure installed with an engine and showing a flow of cooling water in the cooling structure with arrows.
Figure 2:
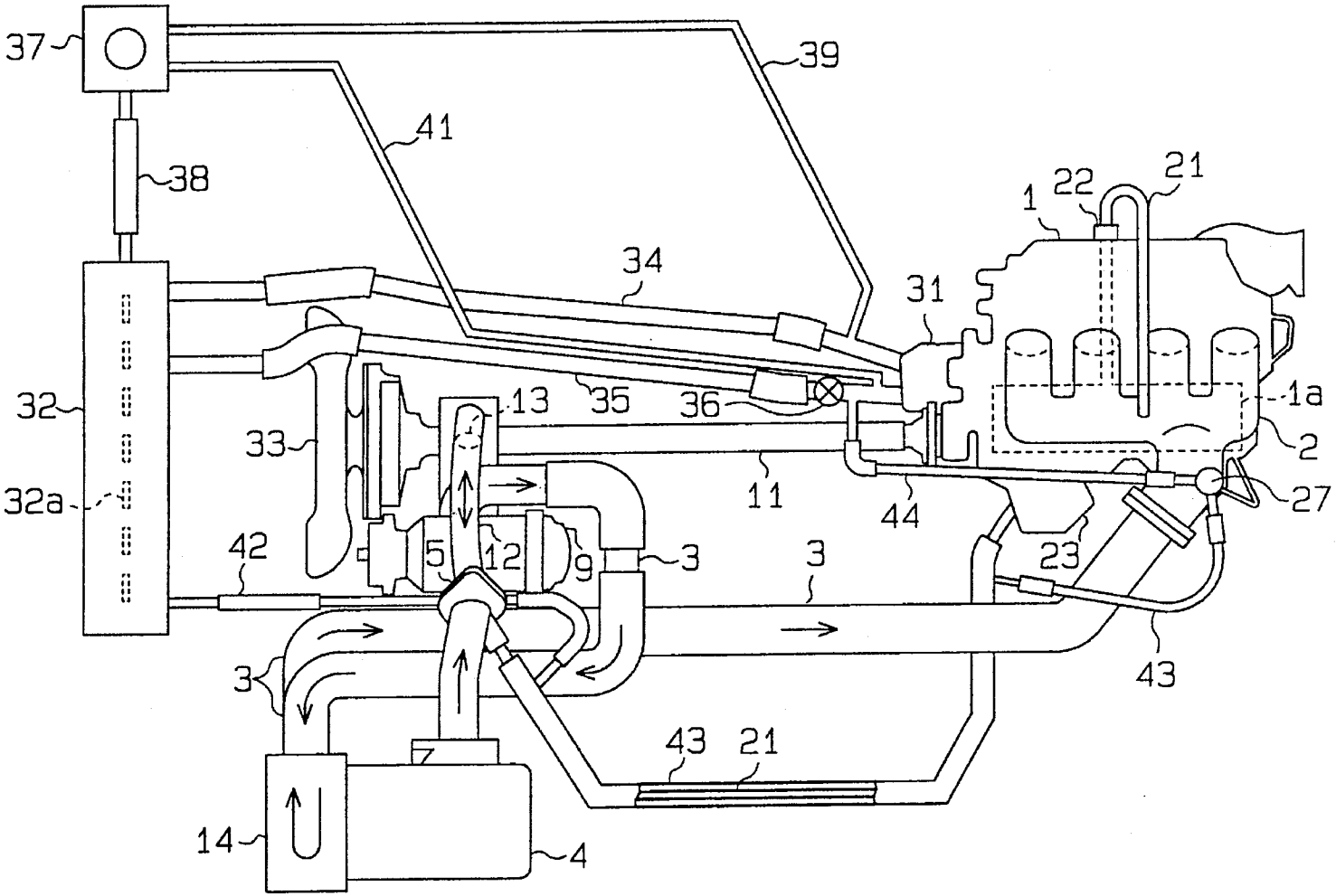
FIG. 2 is a schematic view showing the structure of a PCV apparatus and cooling structure installed with an engine and showing a flow of intake air in the PCV apparatus with arrows.

FIGS. 1 and 2 show a schematic structure of the PCV apparatus and cooling structure for an engine mounted in a vehicle. An engine block 1 has a plurality of cylinders (4 cylinders in this embodiment, not illustrated) including combustion chambers, a crankcase 1*a*, and a crank shaft (not illustrated). An intake manifold 2 is connected to the block 1, and an intake passage 3 is connected to the manifold 2. An air cleaner 4 is disposed at the entrance of the intake passage 3. Mounted on the block 1 are a plurality of injectors (not illustrated). Each injector injects fuel into an associated cylinder. Each combustion chamber sucks the outside air through the air cleaner 4, intake passage 3 and intake manifold 2. Each combustion chamber takes in fuel injected from its associated injector simultaneously with the suction of outside air. The air-fuel mixture burns in each combustion chamber to rotate the crankshaft. The rotation of the crankshaft generates a force for driving the vehicle.

Each combustion chamber exhausts the exhaust gas after combustion to the outside of the vehicle through an exhaust manifold and an exhaust passage (neither illustrated).

Figure 3:
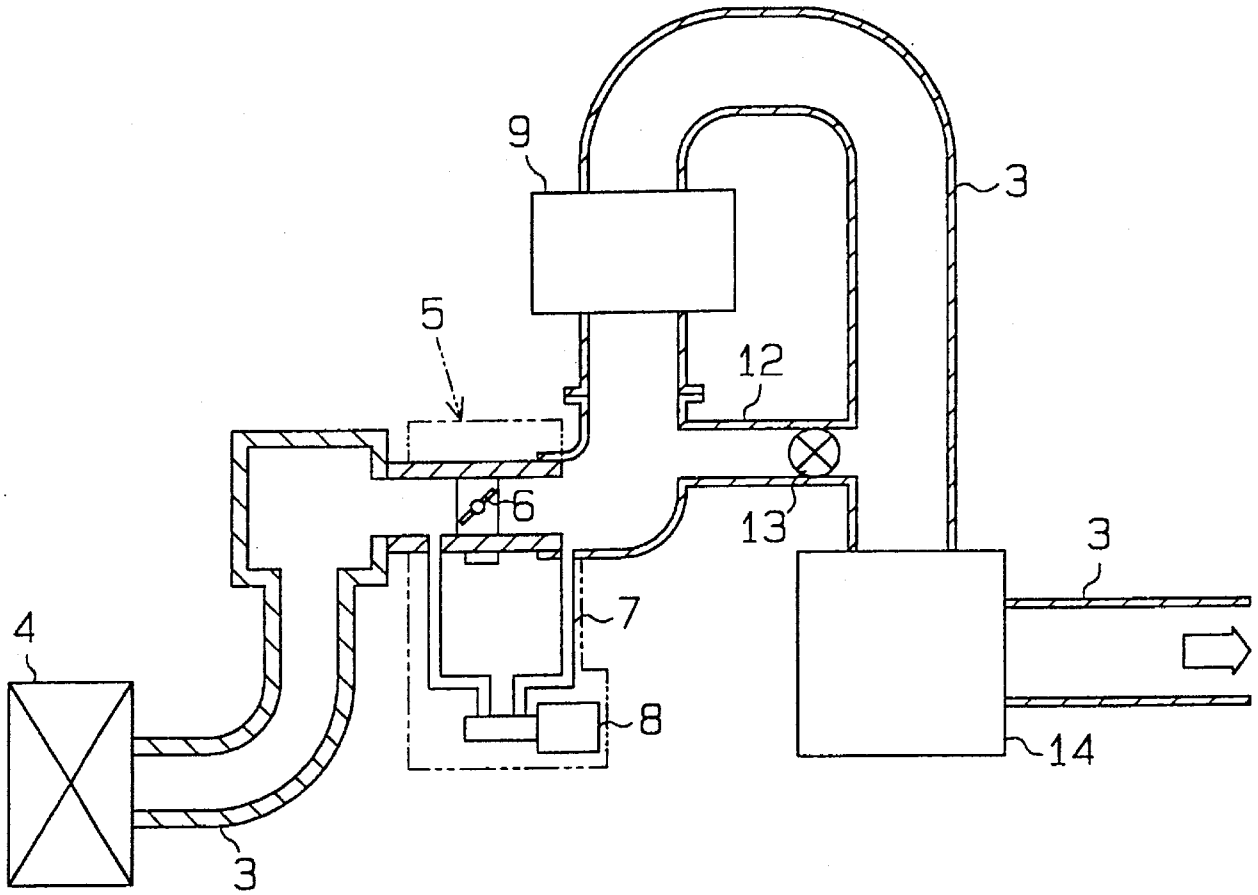
FIG. 3 is a schematic cross-sectional view showing the structure of an intake passage including a throttle body.

A throttle body 5 is disposed in the intake passage 3. As shown in FIG. 3, a throttle valve 6 is provided inside the body 5. The valve 6 operates in an interlocking relation with an accelerator pedal (not illustrated) to open a passage within the body 5. The valve 6 regulates the amount of air flowing through the intake passage 3. A bypass passage 7 provided adjacent to the body 5 connects the upstream and downstream sides of the valve 6. A linear solenoid type idle speed control valve (ISCV) 8 is provided in the passage 7. The ISCV 8 regulates the amount of air flowing through the bypass passage 7. An electronic controller (not illustrated) for controlling the engine controls the ISCV 8 at the time of idling during which the valve 6 is completely closed. With this control, the rotational speed of the engine is controlled. Here, the bypass passage 7 and the ISCV 8 constitute an ISC apparatus.

The engine in the present embodiment has a supercharger 9 as one of accessory devices. The supercharger 9 is disposed in the intake passage 3 at a position away from the block 1. The supercharger 9 supercharges air flowing through the intake passage 3. The vehicle associated with the present embodiment employs a separated accessory drive system (SDS).

In more detail, the throttle body 5 including the valve 6 is located away from the block 1. Also, the distance between a radiator 32, a component of the cooling structure, and the throttle body 5 is less than the distance between the throttle body 5 and the block 1. An SDS shaft 11 transmits the rotation of the crankshaft to the supercharger 9 through a center pulley and an electromagnetic clutch (neither illustrated). The electromagnetic clutch can disengage the transmission of a rotating force from the shaft 11 to the supercharger 9. The supercharger 9 has two built-in rotors (not illustrated). As the two rotors are rotated by the shaft 11, air flowing through the intake passage 3 is supercharged, and consequently more air-fuel mixture flows into each combustion chamber. Since the crankshaft drives the supercharger 9 directly, a supercharging pressure built by the supercharger 9 is proportional to the rotational speed of the engine. Hence, the supercharger 9 has a quick response when the rotational speed of the engine is low, as well as when the rotational speed is high.

A bypass passage 12 branched from the intake passage 3 allows air flowing through the passage 3 to bypass the supercharger 9. An electric air bypass valve (EABV) 13 is provided in the passage 12. The EABV 13 is electrically driven to change its opening. When the engine is idling, the transmission of a rotating force to the supercharger 9 is shut off by the electromagnetic clutch. In such a case, air not flowing through the supercharger 9 flows through the bypass passage 12. The amount of bypassed air is regulated by the EABV 13. When a supercharging pressure built by the supercharger 9 is higher than needed, the EABV 13 is opened to reduce the supercharging pressure. In the intake passage 3, an intercooler 14 is disposed on the downstream side of the supercharger 9. The intercooler 14 cools air which became hot as a result of being supercharged by the supercharger 9.

Accordingly, when the supercharger 9 is driven, air taken into the intake passage 3 through the air cleaner 4 flows to the supercharger 9 through the throttle body 5. The air is supercharged by the supercharger 9, cooled by the intercooler 14, and then taken into each combustion chamber through the intake manifold 2. When the supercharger 9 is not driven, the EABV 13 opens. In this case, air taken into the intake passage 3 does not flow to the supercharger 9, but flows through the bypass passage 12 and then is drawn into each combustion chamber through the intercooler 14 and intake manifold 2. Arrows in FIG. 2 indicate the flow of air through the intake passage 3 and the bypass passage 12.

In the present embodiment, the PCV apparatus comprises a blow-by gas passage 21, a PCV valve 22 and a ventilation case 23. The blow-by gas passage 21 connects the intake passage 3 on the upstream side of the throttle valve 6 and the crankcase 1*a*. Part of the blow-by gas passage 21 is located inside the block 1. The PCV valve 22 is disposed in the blow-by gas passage 21 near the block 1. When the PCV valve 22 opens while the engine is running, a negative pressure or vacuum existing near the throttle valve 6 acts on the blow-by gas passage 21. The blow-by gas (including combustible hydrocarbon) collected in the crankcase la flows into the intake passage 3 and is then taken into each combustion chamber to burn. In the present embodiment, when the supercharger 9 is not driven, there is a possibility that some air taken into the intake passage 3 may flow into the crankcase la through the blow-by gas passage 21 in the direction opposite to the direction of flow of the blow-by gas (to the right in FIGS. 1 and 2).

Figure 4:
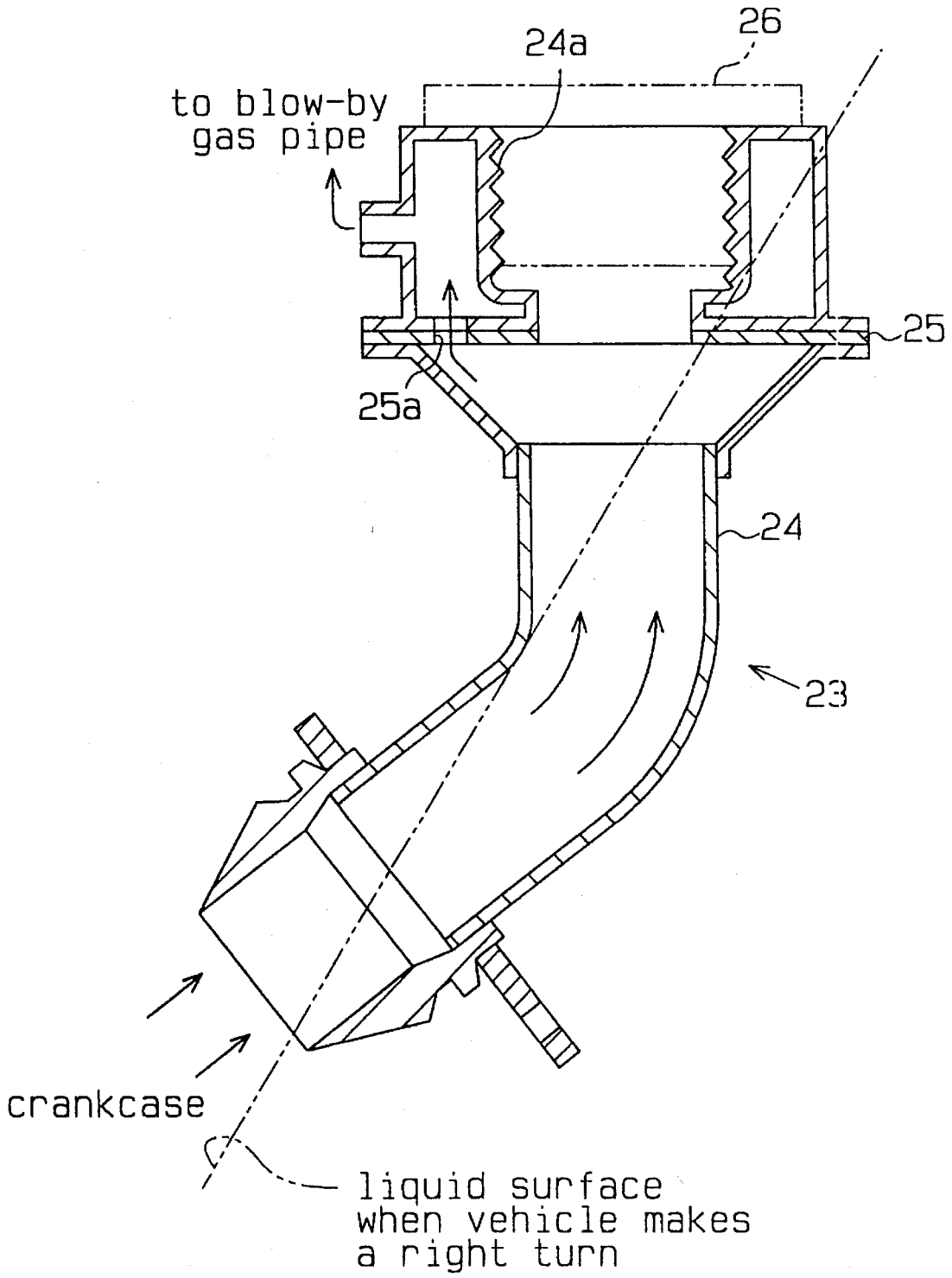
FIG. 4 is a cross-sectional view showing a ventilation case of the PCV apparatus.
Figure 5:
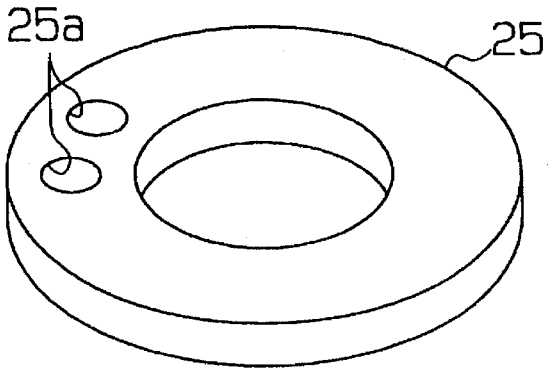
FIG. 5 is a perspective view showing a baffle plate.
Figure 6:
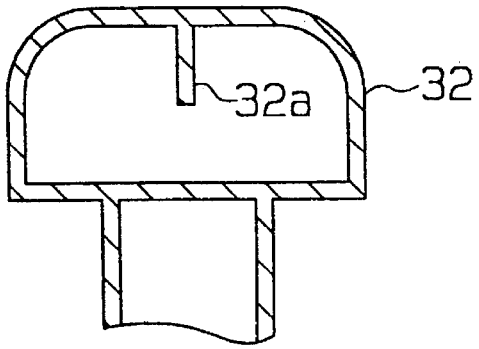
FIG. 6 is a partial cross-sectional view showing the upper portion of a radiator in the cooling structure.
Figure 7:
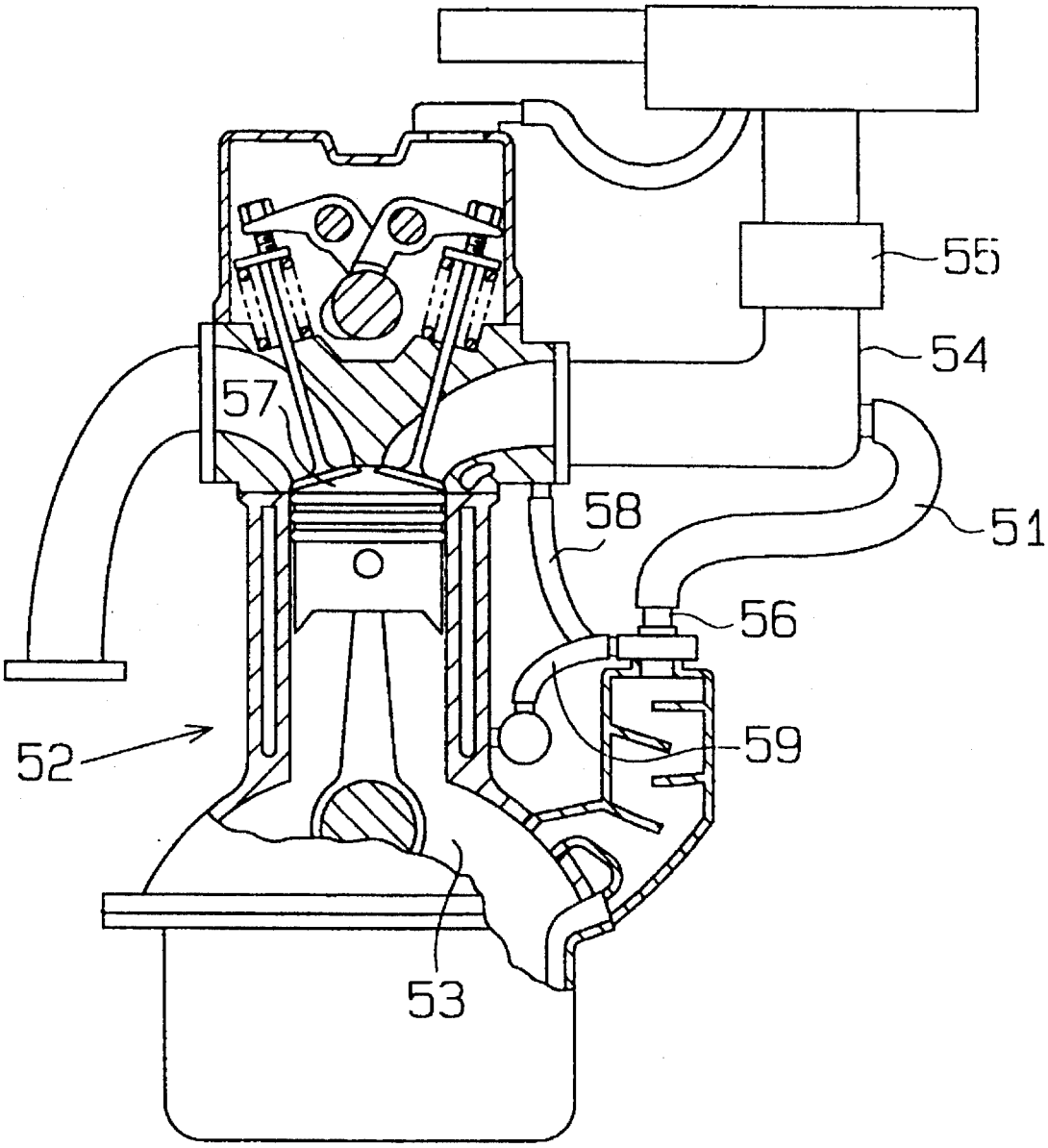
Fig. 7 (Prior Art)
FIG. 7 is a front elevation view with portions cut away showing a conventional PCV apparatus for engines.

The blow-by gas includes oil components such as thickened oil, oil mist and combustible components such as hydrocarbon. Hence, it is necessary to separate oil components from the blow-by gas and to return only combustible components such as hydrocarbon to the intake passage 3. In this connection, the present embodiment provides, as a first device for separating oil, a labyrinthine structure in the blow-by gas passage 21 inside the engine block 1. As the blow-by gas passes through the labyrinthine structure, oil components are separated from the blow-by gas. Moreover, a second device for separating oil components is the ventilation case 23 fixed to the block 1. As shown in FIG. 4, the case 23 has a cylindrical body 24 and a baffle plate 25. An oil cap 26 is screwed into an opening 24*a* of the body 24. Engine oil to be supplied to the engine is put through the opening 24*a*. As shown in FIG. 5, the baffle plate 25 has an annular shape. Two adjacent holes 25*a* are formed in the plate 25. As shown in FIG. 4, when the blow-by gas passes through the case 23, combustible components in the blow-by gas pass through the holes 25*a* and flow further through the blow-by gas passage 21. On the other hand, oil components in the blow-by gas hit the lower surface of the plate 25 and adhere thereto, and hence do not flow further through the blow-by gas passage 21. In the case 23, the arrangement of the holes 25*a* is related to the turning direction of the vehicle. More specifically, a dashed line in FIG. 4 represents the surface of engine oil in the case 23 when the vehicle turns to the right. Such formation of the oil surface depends on the mounted position of the case 23 relative to the vehicle. Thus, slanted oil surface does not contact the holes 25*a*. Accordingly, the engine oil does not leak from the case 23 through the holes 25*a*. Also, since the engine oil contacts the lower surface of the plate 25, oil components adhering to the lower surface return into the engine oil.

The engine in the present embodiment has a well-known exhaust gas recirculation EGR apparatus. The EGR apparatus includes an EGR passage (not illustrated) and an EGR valve 27 (illustrated in FIGS. 1 and 2) disposed in the EGR passage. The EGR passage connects the intake passage 3 and the exhaust passage. The EGR passage recirculates part of the exhaust gas from each combustion chamber to the air-fuel mixture which is to be taken into each combustion chamber. The EGR valve 27 is of the diaphragm type and has a vacuum chamber. When atmospheric pressure acts on the vacuum chamber, the EGR valve shuts off the EGR passage. On the other hand, when a vacuum acts on the vacuum chamber, the EGR valve 27 opens the EGR passage. When the EGR passage opens, the exhaust gas from each combustion chamber passes through the EGR passage based on the pressure difference between the exhaust passage and the intake passage 3 and flows to the intake passage 3. The EGR apparatus employs well-known techniques. Hence, further description of the EGR apparatus is omitted.

The cooling structure of the present embodiment will now be described. The fully closed cooling structure lets cooling water flow in order to cool the block 1. As shown in FIGS. 1 and 2, the block 1 is equipped with a water pump 31. As the crankshaft rotates, the pump 31 operates to pump the cooling water under pressure. The radiator 32 is located at the front (left-hand side in FIGS. 1 and 2) of the vehicle. A cooling fan 33 is located behind the radiator 32. The SDS shaft 11 transmits a rotating force to the fan 33 through the center pulley (not illustrated). The radiator 32 is exposed to the wind coming from ahead when the vehicle is running. Also, the radiator 32 is exposed to the wind from the fan 33. These winds cool the radiator 32 and accordingly the cooling water passing through the radiator 32.

A first water passage or outflow passage 34 connects the pump 31 and the radiator 32. Hence, the cooling water pumped by the pump 31 flows to the radiator 32 through the water passage 34. A second water passage or return passage 35 connects the radiator 32 and the block 1. Hence, the cooling water flows from the radiator 32 to the engine block 1 through the water passage 35. The outflow passage 34 and the radiator 32 form a hot coolant path. A thermostat 36 disposed in the second water passage 35 opens as the temperature of the cooling water rises. Specifically, when the temperature of the cooling water is low, for example, at the start-up of the engine, the thermostat 36 closes. As a result, the cooling water stops flowing through the water passage 35. Accordingly, the cooling efficiency of the cooling structure drops, causing the warm-up of the engine to accelerate. On the other hand, when the temperature of the cooling water rises sufficiently after the engine has warmed up, the thermostat 36 opens. As a result, the cooling water flows to the block 1 through the water passage 35, circulates in the engine block 1, and then flows to the radiator 32 through the pump 31 and the water passage 34. After being cooled by the radiator 32, the cooling water again flows to the block 1 through the water passage 35.

A reservoir tank 37 for storing the cooling water is located away from the block 1. The tank 37 absorbs a change in volume of the cooling water associated with a change in the temperature of the cooling water. An air chamber (not illustrated) provided within the tank 37 is used to separate any gas contained in the cooling water.

A third water passage 38 connects the tank 37 and the radiator 32. A forth water passage 39 connects the water passage 34 and the tank 37. A fifth water passage 41 connects the water passage 35 on the downstream side of the thermostat 36 and the tank 37. Part of the cooling water flows from the radiator 32 to the tank 37 through the water passage 38. Part of the cooling water flows from the block 1 to the tank 37 through the water passage 39. Moreover, the cooling water, from which gas has been removed at the tank 37, flows to the block 1 through both the water passages 41 and 35. As described above, in the fully closed cooling structure, the closing of the thermostat 36 stops the cooling water from flowing from the radiator 32 to the water passage 35. However, as long as the engine is running, the cooling water circulates among the radiator 32, tank 37 and block 1.

In the present embodiment, a sixth water passage 42 extending from the radiator 32 is connected to the vicinity of the throttle body 5. Part of the cooling water flows from the radiator 32 to the periphery of the throttle body 5 through the water passage 42. Thus, the body 5 is warmed or cooled depending on the temperature of the cooling water.

A seventh water passage 43 connects the throttle body 5 and the pump 31. Part of the water passage 43 encloses and runs along the blow-by gas passage 21. In other words, along jointly running portions of the water passage 43 and the blow-by gas passage 21, a double-pipe structure is employed that comprises the blow-by gas passage 21 as an inner pipe and the water passage 43 as an outer pipe. The blow-by gas passage 21 and water passage 43 bend at several locations. At these bends, the blow-by gas passage 21 is in contact with the inner wall of the water passage 43. As a result, the blow-by gas passage 21 is held fixed with respect to the inner wall of the water passage 43. This serves to secure the passage 21 and reduce vibrations. Both ends of the blow-by gas passage 21 are welded to the water passage 43.

The seventh water passage 43 branches from the blow-by gas passage 21 at the vicinity of the block 1 and passes by a location in the vicinity of an EGR valve 27. An eighth water passage 44 connects the water passage 35 on the downstream side of the thermostat 36 and a location near the EGR valve 27. According to this structure, the cooling water flowing around the periphery of the throttle body 5 passes through the water passage 43 and flows further around the periphery of the EGR valve 27. As a result, the EGR valve 27 is warmed or cooled by the cooling water. After flowing around the periphery of the EGR valve 27, the cooling water flows to the pump 31 through the water passage 44. After reaching the pump 31, the cooling water circulates within the block 1 and then is discharged from the pump 31. Thus, the passages 42, 43, 44 and a portion of passage 35 form a heating passage which carries coolant from the hot coolant path to the engine.

In the present embodiment, a plurality of ribs 32*a* are arrayed in the upper portion of the radiator 32 along the width of the radiator 32 such that the ribs 32*a* are located at the center of the thickness thereof. Part of the just-heated cooling water which enters the radiator 32 from the water passage 34 is guided to the ribs 32*a*. As a result, the water in passage 42 is warmer as compared with the case where the ribs 32*a* are not provided.

Actions and effects of the present embodiment will now be described. When the engine starts, the pump 31 operates. When the temperature of the cooling water is low immediately after the start-up of the engine, the thermostat 36 closes. As a result, the cooling water flows from the block 1 to the radiator 32 through the water passage 34. After being cooled by the radiator 32, the cooling water flows to the tank 37 through the water passage 38. The cooling water discharged from the pump 31 also flows to the tank 37 through the water passage 39. Then, the cooling water flows from the tank 37 to the block 1 through the water passage 41. The cooling water circulates within the block 1 to cool the block 1.

Then, when the temperature of the cooling water rises, and consequently when the thermostat 36 opens, the cooling water flows from the radiator 32 to the block 1 through the water passage 35. Accordingly, in the cooling structure of the present embodiment, the cooling water flows to the radiator 32 while the engine is running, irrespective of whether the thermostat 36 is closed or opened.

In the engine associated with the present embodiment, the supercharger 9 is disposed away from the block 1. As a result, the throttle body 5 including the throttle valve 6 is also disposed away from the block 1. Moreover, the valve 6 is closer to the radiator 32 than to the block 1. As a result, the blow-by gas passage 21 becomes longer, and consequently there is a possibility that the blow-by gas passage 21 will freeze when the engine is not running. However, in the engine associated with the present embodiment, the water passage 43 encloses the blow-by gas passage 21 in an area extending in the lengthwise direction thereof. In addition, the cooling water which flows from the radiator 32 into the water passage 42 enters and passes through the water passage 43. Hence, the cooling water flowing through the water passage 43 warms the blow-by gas passage 21.

In the above-described structure, the water passages 34 and 42 serve as a water feed passage to transfer the cooling water to the water passage 43 in order to warm the gas passage 21. Thus, there is no need for a special lengthy passage to carry water from the pump outlet to the far end of the heating passage for the gas passage 21. Instead, a relatively short passage 42 serves to deliver water from the radiator to the passage 43. Also, the water passage 43 itself serves as a water return passage to return the cooling water to the pump 31. The length of the water passage 43, therefore, may be set to the distance between the throttle body 5 and the block 1. Hence, the path taken by the water to reach the passage 43 is not as subject to heat loss and flow resistance, and the temperature of the cooling water does not drop remarkably while the cooling water is flowing through the water passage 43. As a result, the water passage 43 allows the cooling water to effectively warm the blow-by gas passage 21, thereby effectively preventing the blow-by gas passage 21 from freezing.

In the fully closed cooling structure of the present embodiment, the cooling water flows to the radiator 32 while the engine is running. Accordingly, the cooling water flows continuously from the radiator 32 to the water passages 42 and 43. Moreover, in the fully closed cooling structure, a larger amount of cooling water circulates therein compared to cooling structure of other types. Thus, more cooling water flows through the water passage 43, thereby further improving the aforesaid preventive effect against freezing.

Moreover, in the present embodiment, the cooling water passing through the water passage 42 flows around the periphery of the throttle body 5. Thus, the throttle body 5 and the ISC apparatus are warmed before the blow-by gas passage 21 is warmed. Accordingly, the temperature difference between the ISC apparatus and the block 1 becomes smaller, and consequently the difference in air density between the ISC apparatus and each combustion chamber becomes smaller. Hence, even when the ISC apparatus is located away from the block 1 as in the present embodiment, the difference between air flow regulated in the ISC apparatus and an actual air flow to each combustion chamber becomes smaller. As a result, it is possible to improve the accuracy of the idling speed control.

Also, in the present embodiment, only combustible components of the blow-by gas flow out of the case 23 through the holes 25*a* when the blow-by gas passes through the case 23. On the other hand, oil components of the blow-by gas adhere to the plate 25 and remain in the case 23. Thus, combustible components of the blow-by gas can be separated from oil components in the case 23. Moreover, the holes 25*a* in the case 23 are arranged so as not to come in contact with the engine oil surface. Hence, the engine oil will not leak from the case 23 through the holes 25*a* even when the vehicle makes a turn.

Furthermore, in the present embodiment, a plurality of ribs 32*a* are arranged in the upper portion of the radiator 32. This arrangement allows part of the cooling water entering from the water passage 34 to the radiator 32 to quickly (before significant cooling) flow to the water passage 42 through the radiator 32. Accordingly, the thermal capacity of the cooling water which is to be heat exchanged in the radiator 32 becomes smaller. As a result, the effect of warming the blow-by gas passage 21 by the cooling water flowing through the water passage 43 can be enhanced, leading to an improvement of the preventive effect against the freezing of the blow-by gas passage 21.

Although only one embodiment of the present invention has been described herein, it should be apparent to those skilled in the art that the present invention may be embodied in many other specific forms without departing from the spirit or scope of the invention. Particularly, it should be understood that the present invention may be embodied in the following forms.

In the preferred and illustrated embodiment, the water passage 43 encloses the blow-by gas passage 21. However, the water passage 43 may be disposed to run along the blow-by gas passage 21 in an externally contacting manner.

In the preferred and illustrated embodiment, the ventilation case 23 having a special structure is employed. However, a ventilation case having a conventional structure may be used.

In the preferred and illustrated embodiment, the fully closed cooling structure is employed to increase the circulating flow of the cooling water. However, a cooling structure of other than the fully closed type may be employed.

In the preferred and illustrated embodiment, the cooling water from the radiator 32 passes around the periphery of the throttle body 5 and the EGR valve 27. However, the structure for causing cooling water to pass around the periphery of the members 5 and 27 may be omitted.

Therefore, the preferred and illustrated embodiment is to be considered as illustrative and not restrictive and the invention is not to be limited to the details given herein, but may be modified within the scope of the appended claims.

What is claimed is:

1. A positive crank ventilation apparatus for an engine system, the system including:

an engine having a block, and a crankcase wherein said crankcase contains blow-by gas;

an engine cooling structure including:

a radiator spaced apart from said engine;

an outflow coolant passage connecting said engine to said radiator and a coolant return passage connecting said radiator to said engine, said outflow coolant passage and said radiator forming a hot coolant path;

a pump for forcing coolant through said outflow coolant passage towards said radiator;

an air intake passage having a throttle valve disposed therein, said throttle valve being spaced apart from said engine block and located closer to said radiator than to said engine block; said apparatus comprising:

a gas passage for directing the blow-by gas to the air intake passage;

a valve for controlling the flow of blow-by gas in the gas passage;

a heating passage for heating said gas passage and connecting said hot coolant path to said engine, said heating passage including a first portion extending from said hot coolant path to said gas passage and a second portion extending along a substantial portion of said gas passage, said first portion being shorter in length than the distance between said throttle valve and said engine.

2. The apparatus according to claim 1 wherein said engine system includes a supercharger for pressurizing the air flowing within the air intake passage.

3. The apparatus according to claim 1 wherein said intake passage includes a throttle body housing the throttle valve and wherein said heating passage extends through said throttle body to heat said throttle body.

4. The apparatus according to claim 1 wherein said second portion of said heating passage is arranged to enclose a substantial portion of said gas passage.

5. The apparatus according to claim 1 wherein an upstream end of the first portion of the heating passage is connected to said radiator.

6. A positive crank ventilation apparatus for an engine system, the system having an engine, a throttle valve disposed in an air intake passage, and a cooling structure for cooling the engine block with cooling water, wherein blow-by gas leaked from the engine into a crank case of the engine is directed to the intake passage through a gas passage, said apparatus comprising:

valve means for controlling flow of the blow-by gas in the gas passage; and said cooling structure including pump means, heat exchange means, a first passage, a second passage, thermally opening means and a third passage to define a circulating passage of the cooling water, wherein (a) said pump means forces the cooling water to pass through and out of the engine block;

(b) said heat exchange means receives the cooling water pumped out of the engine block to facilitate heat exchange between air outside of the heat exchange means and the cooling water so as to decrease the temperature of the cooling water;

(c) said first passage connects the pump means with the heat exchange means to supply the cooling water to the heat exchange means from the pump means;

(d) said second passage connects the heat exchange means with the engine block to return the cooling water to the engine block;

(e) said thermally opening means selectively opens and closes the second passage based on the temperature of the cooling water; and (f) the third passage extends along and heats a substantial portion of the gas passage and connects the heat exchange means with the engine block to return cooling water to the engine block.

7. The apparatus as set forth in claim 6, wherein said heat exchange means includes a radiator connected with the engine block by way of the first, second and third passages.

8. The apparatus as set forth in claim 7, wherein said thermally opening means includes a thermostat disposed in the second passage, said thermostat opening the second passage when the temperature of the cooling water is in excess of a predetermined value.

9. The apparatus as set forth in claim 8, wherein said radiator and the throttle valve are separated from each other by a first space, and said throttle valve and the engine block are separated from each other by a second space greater than the first space.

10. The apparatus as set forth in claim 9, further comprising a supercharger disposed in the intake passage for pressurizing the air flowing within the intake passage.

11. The apparatus as set forth in claim 10, wherein said third passage is arranged to enclose a substantial portion of the gas passage.

12. The apparatus as set forth in claim 11, wherein said intake passage includes a throttle body housing the throttle valve, said throttle body further including a bypass passage for allowing the flow of the air to bypass the throttle valve and a valve for controlling an opening size of the bypass passage to control the speed of the engine during idling.

13. The apparatus as set forth in claim 12, wherein said third passage extends through the throttle body.

14. The apparatus as set forth in claim 13 further comprising a ventilation case connected with the gas passage for separating oil components contained in the blow-by gas.

15. The apparatus as set forth in claim 6 further comprising:

a reservoir for storing the cooling water and removing air contained in the cooling water;

a fourth passage connecting the radiator with the reservoir for guiding the cooling water out of the radiator to the reservoir; and a fifth passage connecting the reservoir with the engine block for guiding the cooling water out of the reservoir to the engine block.

16. A positive crank ventilation apparatus for an engine system, the system having an engine, a throttle valve disposed in an air intake passage, and a cooling structure for cooling the engine block with cooling water, wherein blow-by gas leaked from the engine into a crank case of the engine is directed to the intake passage through a gas passage by means of negative pressure generated by the engine, said apparatus comprising:

a valve, disposed in the gas passage, for controlling flow of the blow-by gas in the gas passage; and said cooling structure including a pump, a radiator, a first passage, a second passage, a thermostat, and a third passage to define a circulating passage of the cooling water, wherein (a) said pump forces the cooling water to pass through and out of the engine block;

(b) said radiator receives the cooling water pumped out of the engine block to facilitate heat exchange between air outside of the radiator and the cooling water so as to decrease the temperature of the cooling water;

(c) said first passage connects the pump with the radiator to supply the cooling water to the radiator from the pump;

(d) said second passage connects the radiator with the engine block to return the cooling water to the engine block;

(e) said thermostat is disposed in the second passage to selectively open and close the second passage, said thermostat opening the second passage when the temperature of the cooling water is in excess of a predetermined value;

(f) said radiator and the throttle valve are separated from each other by a first space, and said throttle valve and the engine block are separated from each other by a second space greater than the first space; and (g) said third passage extends along and heats a substantial portion of the gas passage and connects the radiator with the engine block to return the cooling water to the engine block.

17. The apparatus as set forth in claim 16, wherein the valve selectively permits and cuts off flow in the gas passage.

18. The apparatus as set forth in claim 16, further comprising a supercharger disposed in the intake passage for pressurizing the flowing within the intake passage.

19. The apparatus as set forth in claim 18, wherein said third passage is arranged to enclose a substantial portion of the gas passage.

20. The apparatus as set forth in claim 19, wherein said intake passage includes a throttle body housing the throttle valve, said throttle body further including a bypass passage for allowing the flow of the air to bypass the throttle valve and a valve for controlling an opening size of the bypass passage to control the speed of the engine during idling.

21. The apparatus as set forth in claim 20, wherein said third passage extends through the throttle body.

22. The apparatus as set forth in claim 21 further comprising a ventilation case connected with the gas passage for separating oil components contained in the blow-by gas.

23. The apparatus as set forth in claim 16 further comprising:

a reservoir for storing the cooling water and removing air from the cooling water;

a fourth passage connecting the radiator with the reservoir for guiding the cooling water out of the radiator to the reservoir; and a fifth passage connecting the reservoir with the engine block for guiding the cooling water out of the reservoir to the engine block.

24. A positive crank ventilation apparatus for an engine system, the system having an engine, a throttle valve disposed in an air intake passage, and a cooling structure for cooling the engine block with cooling water, wherein blow-by gas leaked from tire engine into a crank case of tire engine is directed to the intake passage through a gas passage by means of negative pressure generated by the engine, said apparatus comprising:

a valve, disposed in the gas passage, for controlling flow of the blow-by gas in the gas passage; and said cooling structure including a pump, a radiator, a first passage, a second passage, a thermostat and a third passage to define a circulating passage of the cooling water, wherein (a) said pump forces the cooling water to pass through and out of the engine block, (b) said radiator receives the cooling water pumped out of the engine block to facilitate heat exchange between air outside of the radiator and the cooling water so as to decrease the temperature of the cooling water, (c) said first passage connects the pump with the radiator to supply the cooling water to the radiator from the pump, (d) said second passage connects the radiator with the engine block to return the cooling water to the engine block, (e) said thermostat is disposed in the second passage and selectively opens and closes the second passage, said thermostat opening the second passage when the temperature of the cooling water is in excess of a predetermined value, (f) said radiator and the throttle valve are separated from each other by a first space, and said throttle valve and the engine block are separated from each other by a second space greater than the first space, (g) said third passage extends along and heats a substantial portion of the gas passage and connects the radiator with the engine block to return the cooling water to the engine block regardless the temperature of the cooling water, (h) a reservoir for storing the cooling water and removing air in the cooling water, (i) a fourth passage connecting the radiator with the reservoir for guiding the cooling water out of the radiator to the reservoir, and (k) a fifth passage connecting the reservoir with the engine block for guiding the cooling water out of the reservoir to the engine block;

and wherein the apparatus further comprises:

a ventilation case connected with the gas passage for separating oil component contained in the blow-by gas.

* * * * *

UNITED STATES PATENT AND TRADEMARK OFFICE

CERTIFICATE OF CORRECTION

PATENT NO. :5,499,604

DATED : March 19, 1996

INVENTOR(S) :Eiji Ito et al

It is certified that error appears in the above-identified patent and that said Letters Patent is hereby corrected as shown below:

Column 1, line 62, after "some" delete "of".
Column 2, line 6, after "contact" insert --with--.
Column 3, line 65, before "accessory" insert --its--.
Column 12, line 13, change "tire" (both occurrences) to --the--.

Signed and Sealed this

Twentieth Day of August, 1996

*Attest:*

Bruce Lehman

BRUCE LEHMAN

*Attesting Officer*

*Commissioner of Patents and Trademarks*